United States Patent [19]

Primavesi et al.

[11] 4,059,470

[45] Nov. 22, 1977

[54] APPARATUS AND METHOD FOR TRANSFERRING A MATERIAL FROM A CARRIER MEANS TO A SHEET MEANS

[75] Inventors: Otto Hubert Jan Primavesi, Offenbach am Main, Germany; Alexander Primavesi, deceased, late of Offenbach am Main, Germany, by Dagmar Charlotte Primavesi, legal representative

[73] Assignee: J. Bobst et Fils S.A., Switzerland

[21] Appl. No.: 233,638

[22] Filed: Mar. 10, 1972

Related U.S. Application Data

[63] Continuation-in-part of Ser. No. 693,624, Dec. 26, 1967, abandoned.

[30] Foreign Application Priority Data

Dec. 27, 1966 Switzerland ..... 18789/66

[51] Int. Cl.[2] ..... B44C 1/00

[52] U.S. Cl. ..... 156/238; 156/249; 156/285; 156/344; 156/497; 156/529; 156/542; 156/584

[58] Field of Search ..... 156/209, 228, 233, 234, 156/238, 241, 230, 249, 251, 261, 269, 270, 285, 444, 497, 515, 529, 542, 300, 584, 344, 220

[56] References Cited

U.S. PATENT DOCUMENTS

| | | | |
|---|---|---|---|
| 929,421 | 7/1909 | Gubin | 156/584 |
| 2,337,724 | 12/1943 | Mackie | 156/584 |
| 2,961,031 | 11/1960 | Fener | 156/515 X |
| 2,969,300 | 1/1961 | Franz | 156/233 |
| 3,240,652 | 3/1966 | Lamers | 156/584 |
| 3,340,120 | 9/1967 | Fournier | 156/220 |
| 3,458,376 | 7/1969 | Malik | 156/233 |
| 3,483,059 | 12/1969 | Dinter | 156/285 X |
| 3,547,724 | 12/1970 | Zagusta | 156/233 |
| 3,620,874 | 11/1971 | Youngman et al. | 156/270 |
| 3,688,112 | 8/1972 | Morley et al. | 156/542 |
| 3,729,362 | 4/1973 | French et al. | 156/230 |
| 3,736,208 | 5/1973 | Kraft et al. | 156/497 |
| 3,738,888 | 6/1973 | Williams | 156/230 |
| Re. 24,361 | 9/1957 | Brown | 156/497 UX |

*Primary Examiner*—David A. Simmons
*Attorney, Agent, or Firm*—Hill, Gross, Simpson, Van Santen, Steadman, Chiara & Simpson

[57] ABSTRACT

Transfer of a portion of a first material from a position where it is removably adhered to a carrier means to a sheet means is facilitated by intermittently blowing a burst of compressed air between the carrier means and the sheet means after the first material has been brought into contact with the sheet means between a pair of reciprocating dies and is being separated therefrom. With the carrier means moving in one direction and the sheet means moving in an opposite direction the air, which may be warmed, is blown in the direction of the carrier means against the direction of the sheet means so that it exerts a separating effect between the two at their interface. The air may be conveyed through members which serve as guides on one or both sides of the dies. In addition, at least one of the die parts can be provided with a vacuum means for intermittently drawing one of the carrier means or sheet means thereagainst during transfer. An ultrasonic vibrating means which is effective to vibrate the ambient air between the carrier means and the sheet means may be provided in lieu of or in addition to the bursts of air.

6 Claims, 4 Drawing Figures

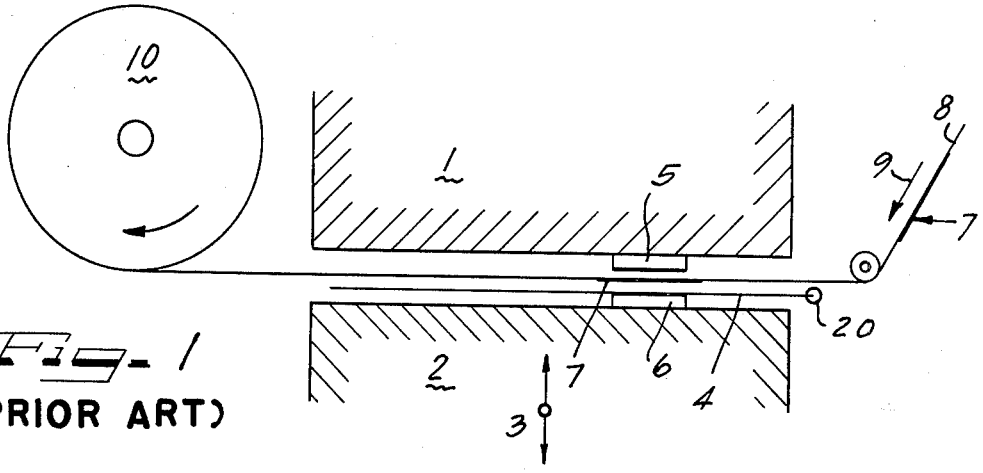
FIG. 1
(PRIOR ART)
FIG. 2
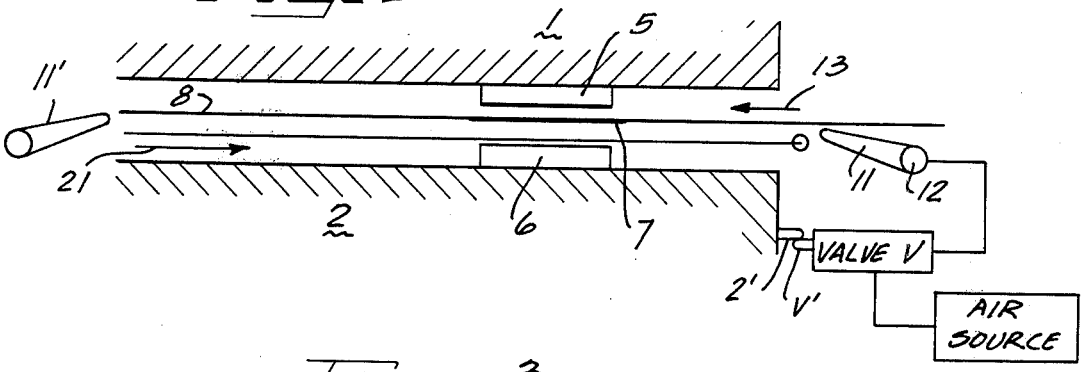
FIG. 3
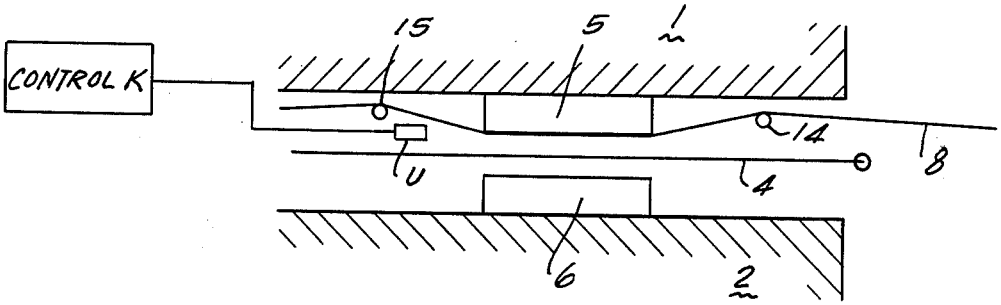
FIG. 4
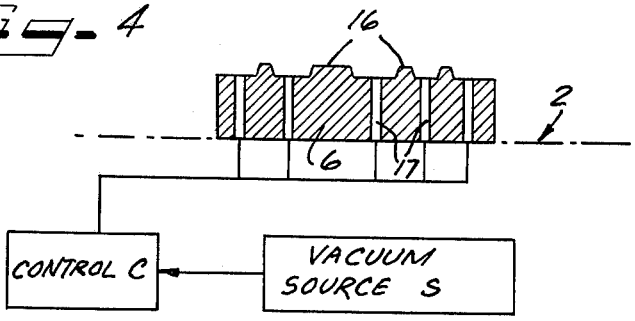

APPARATUS AND METHOD FOR TRANSFERRING A MATERIAL FROM A CARRIER MEANS TO A SHEET MEANS

CROSS-REFERENCE TO RELATED APPLICATIONS

The present application is a continuation-in-part of our copending application U.S. Ser. No. 693,624, filed Dec. 26, 1967 and now abandoned.

BACKGROUND OF THE INVENTION

1. Field of the Invention

This invention generally relates to the printing and embossing arts and more particularly concerns a method and apparatus for transferring a piece of material removably attached to a carrier means from the carrier means to a sheet means in an operation where the material on the carrier means is brought into contact with the sheet means by means such as a reciprocating die means. The material adheres to the sheet means on contact therewith and its removal from the carrier means is facilitated by blowing air between the carrier means and the sheet means at about the time the reciprocating die means begin to separate from each other. With the sheet means being intermittently fed between the reciprocating dies in a direction opposite to the direction which the carrier means moves past the reciprocating dies the air may be blown in a direction opposite to that of the sheet means. The material carried by the carrier means may be a piece or strip of foil which is effectively cut by the reciprocating die means and transferred from the carrier means to the sheet means. With the carrier means and sheet means moving in opposite directions the burst of air directed to the interface of the oppositely moving members makes possible the rapid and complete separation of the cut foil material from the carrier means and the remainder of the foil.

2. Prior Art

It is known in the prior art to provide for the simulataneous positioning of a material on a substantially continuous web means in juxtaposition to a sheet material between a pair of reciprocating dies whereby the dies move the material on the carrier means into contact with the sheet means and transfer the material from the carrier means to the sheet means. The material carried by the carrier means may be a metallized foil or other material which is used in the manufacture of printed and/or embossed containers or other products. While this process and apparatus for carrying out the process are old and well known in the prior art is has remained a relatively slow and troublesome operation which produces a relatively high volume of rejects or simply will not work.

SUMMARY OF THE INVENTION

The problems of the prior art have been overcome by the invention herein whereby a maximum number of articles of highest quality may be produced with a minimum number of rejects. The apparatus for transferring material from one member to another member according to the invention comprises first and second means such as platens relatively reciprocal towards each other to clamp a carrier means and a piece of material removably attached thereto against a sheet means whereby the material adheres to the sheet means on contact and is removed from the carrier means when the sheet means and the carrier means are separated. Separation is assisted by the reciprocating dies moving away from each other and the injection of a fluid such as air therebetween at about the time the reciprocating dies begin to separate from each other. In addition the movement of the sheet stock and carrier means in opposite directions before and after they are brought into material transferring contact further aid the separation with the burst of air being generally in a direction opposite the movement of one of the stock means or carrier means. The fluid which is advantageously heated air works between the sheet means which is usually a piece of sheet stock moved by a gripper bar and the carrier means which is usually a web of backing material having a foil and tends to distribute it pressure around the edges of the piece of foil being removed from the carrier means. The foil may be carried on the backing strip in a continuous layer and in such case would be effectively cut by the action of the dies as the come together to transfer the material, usually foil, from the carrier means to the sheet stock. When the burst or movement of air is set to occur as the dies are separating a rapid and perfect separation occurs everytime whereas before the invention herein defects in the foil separation were common. Where the speed of operation of printers and embossers of this type may exceed 100 embossments per minute rapidity and reliability of operation are extremely important.

In further embodiments of our invention we have provided hollow guide means on one or more sides of at least one of the dies to guide the carrier means. At the same time these guide means may have openings therein to provide the burst or stream of air directed at the interface of the carrier means and sheet means. It is also possible with our invention to vibrate the ambient air between the members with an ultrasonic oscillator to aid in the separation of the material from the carrier means.

We have found that a pulse or burst of air synchronized with the separation of the dies provides for efficient operation. It is theorized that the air pressure created by the pulse of air between the carrier means and the sheet means complements the partial vacuum created by the separating movement of the dies which tends to hold the carrier means or the sheet stock thereagainst for a fraction of a second. In some cases we have found it advantageous to provide vacuum openings in at least one of the reciprocating dies and apply a partial vacuum during separation to thereby assist in the stripping of the transferred material from the carrier means.

The method of transferring material from a material carrying means onto a sheet means according to our invention may be summarized as comprising the steps of positioning the material carrying means and a sheet means in juxtaposition, bringing a portion of the material of the carrying means and the sheet means into contact, and separating the carrying means and the sheet means to leave a portion of the material on the sheet means by blowing a burst of air at the interface of the web means and the sheet means to effect separation of that portion of material from the carrier means. Advantageously the method includes moving the material carrying means and the sheet means in generally opposite directions and blowing the burst of air in the direction of movement of one of the carrying means or sheet means.

Where the portion of the material on the carrying means and the sheet means are brought into contact between a pair of mating three dimensional dies the sheet means is embossed and the material effectively cut so that it covers the area of embossment. During the time the sheet means and the carrier means are in contact they are fixed in position relative to one another. The method may furher include the step of applying a vacuum to one of the dies to hold the respective sheet means or carrying means thereagainst and thereby further aid the stripping process. As stated the synchronization of the burst of air or pulsation of air with the separation of the reciprocating die members enhances the efficiency of the operation.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure and in which:

FIG. 1 is a schematic illustration of a reciprocating press having a die arrangement for transferring material from a carrier means such as a tape web to a sheet means according to the prior art;

FIG. 2 is a schematic enlarged view of a portion of the apparatus of FIG. 1 incorporating the appartus according to the invention herein;

FIG. 3 is a schematic illustration of a further embodiment of the invention illustrating the guides and ultrasonic oscillators; and, FIG. 4 is a schematic greatly enlarged cross sectional view of a die member of FIG. 3 showing yet another embodiment of the invention.

DESCRIPTION OF THE PREFERRED EMBODIMENTS

Referring to FIG. 1 there may be seen an illustration of a known apparatus and process with which the present invention may be very advantageously combined to provide not only for increased speed of operation but also to produce the highest quality work. In FIG. 1 the simultaneous embossing or printing of sheet means 4 is accomplished by intermittently passing a succession of sheets 4 between the stationary upper press plate member 1 and a press plate member 2 which press plate member 2 may be reciprocated in the direction shown by the arrow 3. As shown schematically the upper press plate 1 has a female die means 5 attached thereto which female die 5 is in registration with a male die 6 affixed to the lower moving press plate member 2. In addition to the sheet means 4 which may be a piece of paper or cardboard to be processed there is passed between the die means 5 and 6 a material 7 removably attached to a carrier means 8. The material 7 may be a foil or metallized tape so that the sheet means 4 may be simultaneously embossed and gilded to form such products as cartons or wrappers for chocolates or candies.

The problem in the prior art which we discovered was to deposit the material or foil 7 onto the protruding portions of the sheet material 4 at the moment of pressure application and to then strip the thus cut and deposited material 7 from the remainder of the material 7 and from the carrier means 8. According to the prior art this operation had to be performed slowly and carefully to avoid defects which would require the entire box or card to be rejected. This created bottlenecks in the processing of articles by this means and created a relatively high rejection rate of the articles incorporating this expensive processing. As a result the machines were not being used to maximum efficiency and the costs of production were relatively very high.

By means of our invention it is now possible to not only speed up prior art process but to produce articles of highest quality with a minimum number of rejects. This is accomplished according to our invention as illustrated, for example, in FIG. 2, by moving the carrier means such as the tape web 8 in the direction of the arrow 9 between a supply storage means which is not shown and a take-up drum 10 while intermittently feeding a series of sheet means 4 in an opposite direction such as illustrated by the arrow 21 by conventional means such as chain driven gripper bars 20 which grasp the forward edge of an individual sheet and intermittently pull it into an exact position beteen the die members 5 and 6.

The carrier means 8 may carry the material 7 over its entire face or have individual pieces of the material 7 arranged thereon. At any rate, the process is synchronized so that the material 7 is arranged above the sheet 4 between the die means 5 and 6, so that at the moment of contact, which will involve the elements being held under pressure between the dies 5 and 6, the material 7 adheres to the sheet means 4 in the area where it has been brought into contact therewith by the dies 5 and 6. The pressure of the contact either with additional embossment or in a flat state serves to effectively severe the transferred portion of the material 7 from the portion of the material 7 which will remain on the carrier means 8 and will be coiled up with the tape web in the roll 10. Immediately following the application of pressure by the dies 5 and 6 between the carrier means 8 the material 7 and the sheet means 4 a rapid and positive separation must be effected of the transferred portion of the material 7 from the carrier means such as the tape web 8. Also, the material 7 must be effectively severed. It was for the purpose of assuring this separation that the combination according to the present invention was discovered.

According to our invention as shown in FIG. 2 the equipment includes a source of air generally indicated at 11 oriented in such a manner as to exert a separating action between the sheet means 4 having the transferred portion of the material 7 adhered thereto and the carrier means 8 having the remainder of the material 7 thereon. The pneumatic means may be a stream or jet of a gaseous fluid or an action provoked by movement of ambient air as, for example, air under the influence of ultrasonic oscillations. Other arrangements can, as will be seen, complement the one which has been disclosed. Thus, for example, several nozzles may be mounted next to each other or a longitudinal slot may be used depending on the width of the area to be treated.

It is our discovery that the pressure of the stream or burst of air is distributed about the perimeter of the portion of the material 7 which is being removed from the carrier means 8 so that as the rapidly moving die member 6 moves away from its position and pressure contact with the die member 5 a partial vacuum is created between the die 6 and the sheet means 4 on the bottom side of the sheet means 4 which is complemented by the pneumatic pressure on the upper side of the sheet means 4 and below the carrier means 8. We have also discovered that while the movement of the sheet means 4 relative to the carrier means 8 may be in any direction and the air similarly may be applied in any direction, it is advantageous to have the carrier means 8 and the sheet means 4 moving in generally opposite directions with the gaseous fluid from the source 11 directed generally in the direction 13 which is the same as the direction of the carrier means 8 and opposite to the direction of the sheet means 4. In the example illustrated the jet of air is oriented toward the interface of the sheet stock or paper sheet 4 and the carrier means or web 8. It might be possible in special circumstances to orient the nozzle in the position of nozzle 11' to blow air in the opposite direction. However, ordinarily the nozzle must be oriented in the position of the nozzle or air source 11 inasmuch as the sheet stock 4, which may be of different lengths, is pulled through the apparatus between the platens by a gripper bar assembly 20 or the like in a direction opposite the direction of movement of the web 8. If the air stream were blown from a nozzle in the position of the nozzle 11' and the sheet stock were short, the air stream might tend to maintain the sheet stock and the web in engagement with one another rather than to effect a separating operation.

It will be understood that it is important to create a movement of the air which will act to create a pressure differential between the sheet means 4 and the carrier means 8 whereby the portion of the material 7 adhering to the sheet means 4 will be rapidly and uniformly stripped from the carrier means 8 and the remaining portion of the material 7. This invention has contributed significantly to the efficiency of operation of the apparatus and process and without our invention the apparatus of the prior art simply does not work.

As shown in FIG. 2 it is possible to synchronize the burst of air so that it occurs in each work cycle immediately following the pressure application between the dies 5 and 6. For this intermittent action a valve V may be provided which has a valve control member schematically illustrated at V' which is tripped by a protrusion 2' on the moving portion of the press 2. By this means bursts or pulses of air from an air source indicated will be controlled to coincide with the movement of the dies 5 and 6 relative to each other.

It is the advantageous combination of features which provides the new and what we consider to be unexpected results of the invention.

Referring to FIG. 3 which maintains similar numbering of the elements there may be seen, on a slightly enlarged scale, auxiliary equipment complementing that shown in FIG. 2. Thus, it may be seen that an ultrasonic oscillator U is provided between the carrier means 8 and the sheet means 4 in the proximity of the dies 5 and 6 which is controlled by a control K to vibrate the ambient air between the sheet means 4 and the carrier means 8 in synchronization with the separating movement of the die members 5 and 6. Depending upon the application it is possible that the oscillator U may be provided in lieu of or in addition to the sources of air 11 and/or 11'.

In addition, we have found that in the limited space between the press means 1 and 2 and the die members 5 and 6 which are carried by the members 1 and 2, the carrier means or tape web 8 may seize or rub against the sheet means 4 and/or the lower plate 2 with the result that the carrier web tape 8 may deteriorate and/or leave behind unwanted deposits. In order to prevent this situation from occurring we have added in addition to the aforementioned pneumatic means, transverse tubular members such as indicated at 14 and 15 which members are of a diameter or a thickness less than the height of the female dies 5 and the carrier means 8 between the die members 5 and 6. These guide members 14 and 15 may be integral with the upper press plate 1 which press plate may carry a suspension means permitting the insertion of the guide members 14 and 15 below the trajectory of the carrier tape web 8. This also serves to improve the angular relationship between the separating carrier means 8 and the sheet means 4 and to allow more ready access of the stream or burst of gaseous fluid.

The guide members 14 and 15 may also serve as piping elements having nozzles or orifices permitting the sending of jets or pulses of pressurized gaseous fluids between the sheet means 4 and the tape means 8 to either complement or replace the actions of the nozzles 11, 11', previously described. We have found it advantageous in many cases to heat the die members 5 and 6 to facilitate the transfer of the material 7 and in such cases is is preferable to assist the separating action according to the invention by heating the gaseous fluid such as air to a temperature of approximately 194° F. The heating may be done by any appropriate heating means as will be known to those skilled in the art and for that reason will not be illustrated here. Further control of the temperture may be effected by providing means in the guide members 14 and 15 for heating or cooling of the operative parts and/or the carrier means 8.

In spite of the very close control of the heat and the guides provided for the carrier means 8 and the sheet means 4 there may remain a tendency of the carrier means 8 to adhere to the sheet means 4 and in such cases we have provided a vacuum source connected to a male die 6 as shown in enlarged cross section in FIG. 4. It will be there seen that channels 17 connected to a vacuum source S through a control C are provided between active protruding portions 16 of the male die so that the sheet means 4 may be held on its lower side by the press member 2 and pull away together with the adhered portion of the material 7 from the carrier means 8.

The method of transferring material 7 from a material carrying means 8 onto a sheet means 4 according to our invention comprises the steps of positioning the material carrying means 7, 8 and the sheet means 4 in juxtaposition between a pair of die members 5 and 6 with the material 7 on the side of the carrier means 8 facing the upper side of the sheet means 4, bringing a portion of the material 7 of the carrying means 8 and the sheet means 4 into contact under pressure whereby the portion of the material 7 between the dies is effectively cut from the remaining portion of the material 7 and more strongly adhered to the sheet means 4 than it is to the carrier means 8 whereby the die means 5 and 6 are separated to allow the carrier means 8 and the sheet means 4 to also separate in the area of the transferred material 7 the portion of the material 7 which was acted on by the die members 5 and 6 will remain on the sheet means 4 and be effectively stripped from the carrier means 8. This separating of the material is caused by the step of blowing a burst of air at the interface of the web means 8 and the sheet means 4 to effect separation of that portion of the material from the carrier means 8. Advantageously the method includes moving the material carrying means 8 and the sheet means 4 in generally opposite directions and blowing the burst of air in the direction of movement of one of the carrying means 8 or the sheet means 4. The dies 5 and 6 may be either two or three dimensional and will hold the sheet means carrier means in contact in fixed relation to one another.

As a further step the method may include applying a vacuum to one of the dies to hold the respective sheet means or carrying means thereagainst and thereby further aid in the stripping process. Synchronization of the burst of air or pulsation of air with the separation of the reciprocating die members 5 and 6 increases the efficiency of the operation.

Although minor modifications might be suggested by those versed in the art, it should be understood that we wish to embody within the scope of the patent warranted hereon all such modifications as might reasonably and properly come within the scope of our contribution to the art.

We claim:

1. An apparatus for transferring material from one member to another comprising:

first and second means relatively reciprocable towards each other to clamp said members therebetween and effect transfers of said material from said one member to the other in sequential operations, and separating means including means to inject a hot gaseous fluid between said members after each transfer and including means to heat said fluid.

2. An apparatus for transferring material from one member to another comprising:

first and second means relatively reciprocable towards each other to clamp said members therebetween and effect transfers of said material from said one member to the other in sequential operations, and separating means including an oscillator adapted to vibrate ambient air between said members.

3. A method of transferring material from a material carrying means onto a sheet means comprising the steps of positioning the material carrying means and a sheet means in juxtaposition, bringing a portion of the material of the carrying means and said sheet means into contact, and separating the carrying means and the sheet means to leave a portion of the material on the sheet means by vibrating ultrasonically the ambient air between said carrying means and said sheet means.

4. An apparatus for transferring material from one member to another member comprising:

first and second means relatively reciprocable towards each other, including plates and dies protruding from the plates, to clamp said members therebetween and effect transfer of said material from said one member to the other in sequential operations, guide means disposed between said first and second means adjacent to one of said plates at a lesser height than the corresponding die for guiding the corresponding member, and separating means integral with said guide means to inject a gaseous fluid between said members after each transfer.

5. A method of transferring material from a material carrying means onto a sheet means comprising the steps of positioning the material carrying means and a sheet means in juxtaposition by moving the material carrying means and sheet means to a given position, applying pressure to bring a portion of the material of the carrying means and said sheet means into contact, and separating the carrying means and the sheet means to leave a portion of the material on the sheet means by removing the pressure and creating a burst of air flowing in a direction of movement of one of the material carrying means and the sheet means and between the interface of the material carrying means and the sheet means to effect separation of said portion of material from said material carrying means, said creating including heating the burst of air.

6. A method of transferring material from a material carrying means onto a sheet means comprising the steps of positioning the material carrying means and a sheet means in juxtaposition by moving the material carrying means and sheet means to a given position, applying pressure to bring a portion of the material of the carrying means and said sheet means into contact, and separating the carrying means and the sheet means to leave a portion of the material on the sheet means by removing the pressure and by ultrasonically vibrating ambient air to create a burst of air flowing in a direction of movement of one of the material carrying means and the sheet means and between the interface of the material carrying means and the sheet means to effect separation of said portion of material from said material carrying means.

* * * * *